US011672316B2

(12) United States Patent
Woodman

(10) Patent No.: US 11,672,316 B2
(45) Date of Patent: Jun. 13, 2023

(54) COMBINATION SHOE CARRIER AND TOWEL

(71) Applicant: John Woodman, Fleming Island, FL (US)

(72) Inventor: John Woodman, Fleming Island, FL (US)

( * ) Notice: Subject to any disclaimer, the term of this patent is extended or adjusted under 35 U.S.C. 154(b) by 388 days.

(21) Appl. No.: 17/143,372

(22) Filed: Jan. 7, 2021

(65) Prior Publication Data

US 2022/0211152 A1 Jul. 7, 2022

(51) Int. Cl.

| | |
|---|---|
| ***A45C 3/00*** | (2006.01) |
| ***A45C 9/00*** | (2006.01) |
| ***A45C 3/12*** | (2006.01) |
| ***A45C 13/10*** | (2006.01) |
| ***A47K 10/02*** | (2006.01) |

(52) U.S. Cl.

CPC ..... *A45C 9/00* (2013.01); *A45C 3/001* (2013.01); *A45C 3/12* (2013.01); *A45C 13/103* (2013.01); *A45C 13/1076* (2013.01); *A47K 10/02* (2013.01); *A45C 2013/1015* (2013.01)

(58) Field of Classification Search

CPC ... A45C 13/1076; A45C 13/103; A45C 13/26; A45C 13/03; A45C 3/004; A47K 10/02

USPC ..... 206/579, 3, 15.1, 278, 6.1

See application file for complete search history.

(56) References Cited

U.S. PATENT DOCUMENTS

| | | | | |
|---|---|---|---|---|
| 4,669,772 | A | 6/1987 | Waller | |
| 5,135,275 | A | 8/1992 | Kettelson | |
| 5,506,170 | A | 4/1996 | Lofaro | |
| 6,616,225 | B2 | 9/2003 | Graff | |
| 6,669,016 | B1 | 12/2003 | Carson | |
| D727,025 | S | 4/2015 | Dreyer | |
| 9,169,057 | B2 | 10/2015 | Bookhammer | |
| D742,637 | S | 11/2015 | Miles | |
| D830,083 | S | 10/2018 | Telus | |
| 2005/0194803 | A1 | 9/2005 | Perry | |
| 2006/0180484 | A1* | 8/2006 | Jones | A45C 3/12 206/278 |
| 2014/0209493 | A1* | 7/2014 | Hale | A45C 15/06 206/281 |
| 2016/0166023 | A1* | 6/2016 | Graham | A45C 3/004 206/279 |
| 2017/0238663 | A1 | 8/2017 | Minten | |

* cited by examiner

*Primary Examiner* — King M Chu

(74) *Attorney, Agent, or Firm* — Lawrence J. Gibney

(57) ABSTRACT

The device will allow the sportsman to carry a pair of shoes and a towel together. The issue of forgetting a towel when one is needed will be eliminated with this device. The device is easily hand washed or machine washed and can be reused as often as possible. It is also designed to be subjected to a range of environmental conditions including extremes in weather and temperature.

16 Claims, 6 Drawing Sheets

COMBINATION SHOE CARRIER AND TOWEL

FIELD OF THE INVENTION

This application addresses the problem of forgetting a towel when traveling to a sporting event, particularly a sport that is played outdoors. A towel is very common in the game of golf and while a player will hardly ever forget his or her shoes, a towel is a necessary item to frequently wipe down clubs and frequently dry the golf balls during a normal course of eighteen holes of golf.

Although the game of golf will be highlighted in this application, this problem is also present in other sports when items need to be dried from time to time. Example sports include the game of tennis, baseball, and soccer to name a few.

PRIOR ART

There are many other prior art references to towels and shoe carriers. A representative example of this type of device can be found in Minten, U.S. Patent Publication 2017/0238663. The Minten reference states that it is a shoe carrier with an attachable towel. In this application the towel is comprised of one of more inserts in which to store the shoe(s). This combination of shoe carrier towel is not anticipated or taught by Minten.

Another example of the prior art can be found in Waller, U.S. Pat. No. 4,669,772. The Waller references a shoe carrier but includes no towel. There are other prior art references that detail shoe carriers and shoe cleaning items and a representative example of this can also be found in Miles, U.S. Pat. No. D742637.

However, none of the prior art references teach or anticipate the features of the current device.

BRIEF SUMMARY OF THE INVENTION

This is a combination device which combines the benefits of a towel with the benefits of a shoe carrier. The shoe carrier part of the device is on one side of the device and the towel material is on the opposite side. The shoe carrier will have pockets which are lined in plastic to prevent the cleat of the shoe grabbing the interior of the pocket.

The towel surface will be on one side of the device and the shoe carrier will be on approximately one-half of the second side of the device. A pouch with a bottom and sides and an opening for the shoe on the top will allow the storage of shoes in the device.

A plastic sheath will be placed in the pouch for the shoe carrier to prevent the towel from getting excessively soiled during normal use and to make it easier to clean the device. The device is designed to be washable and reusable and the material that is selected should be suitable for all environmental hazards and temperature extremes.

Two embodiments will be described in this application.

In the first embodiment each section of the towel will fold over the respective shoe that is contained in the pouch and the two section will fold at the center line between the two pouches for the shoes. In this embodiment a means to attach the sides of device will be provided on the respective sides for each shoe. In the folded state the towel surface will fold over each shoe that is contained in its respective pouch. The towel can be used as an ordinary towel.

In the second embodiment the shoes will be placed on one side of the device and the towel will fold over the shoes.

Regardless of the embodiment a strap will be provided to easily carry the device once it is folded.

Although the golf example is discussed in this application, this device can be used in other sporting activities such as baseball, softball, and tennis to name a few examples.

NUMBERING REFERENCES

1—Device
5—Towel
10—Strap
11—Snap
15—Connection Means
20—Pouch
25—Shoe(s)

DETAILED DESCRIPTION OF THE EMBODIMENTS

This device 1 is a combination towel, and shoe carrier. Although golf shoes are mentioned specifically in this application, this device can be used for any type of athletic footwear, and this includes baseball shoes, baseball cleats, football cleats, soccer cleats, tennis shoes or any other shoe that must be carried to any athletic event. This device will be particularly useful with outdoor sports where the footwear that is worn by the participant will become soiled.

First Embodiment

In the first embodiment the device 1 will consist of two sections of equal size. The towel material 5 will be on one side of the device and a pair of pouches 20—one on each shoe of the towel 5 material—is provided on the opposite side.

Figure 1:
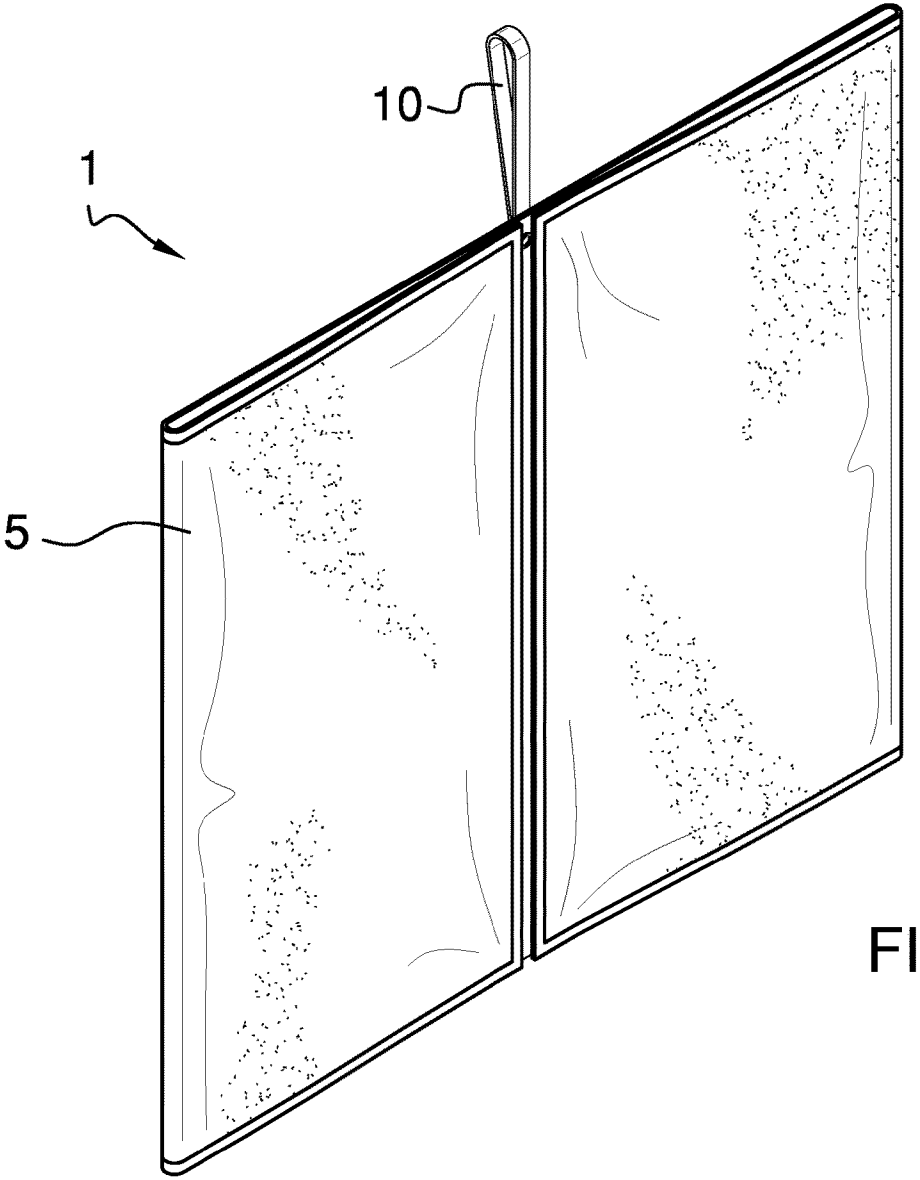
FIG. 1 is an isometric view of the first embodiment with the device empty.
Figure 2:
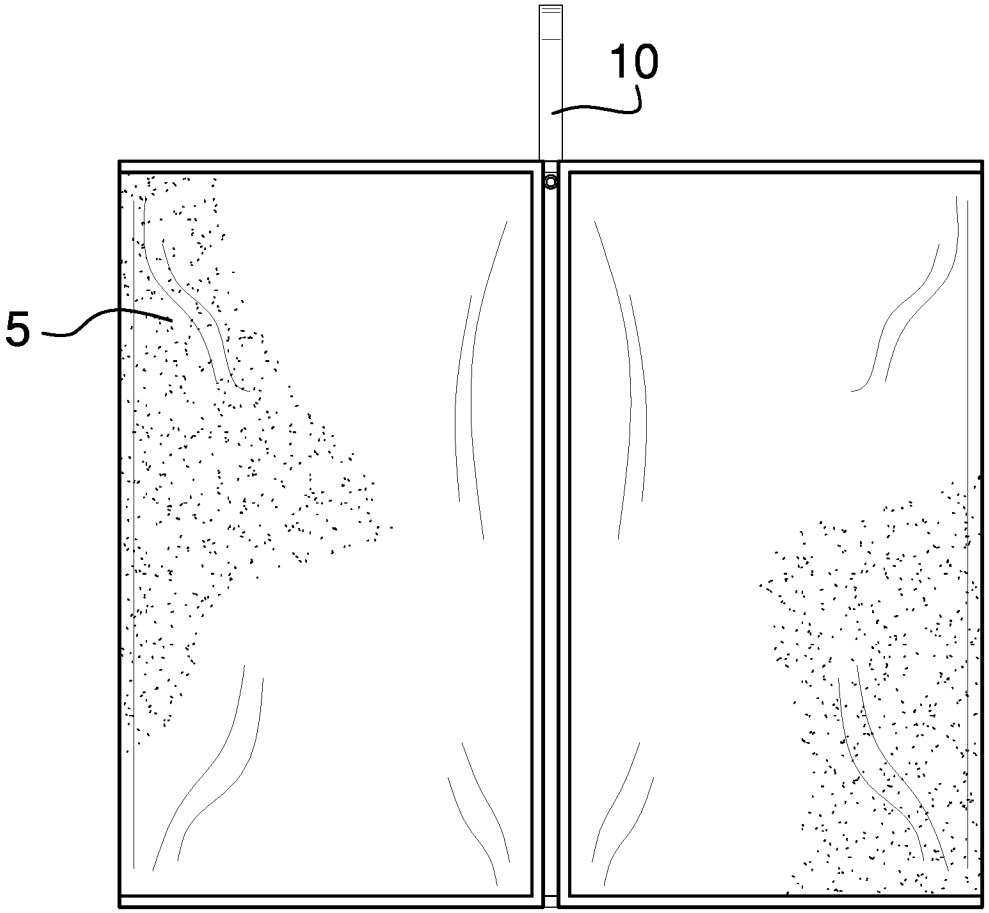
FIG. 2 is a front view of the first embodiment with the device empty.
Figure 3:
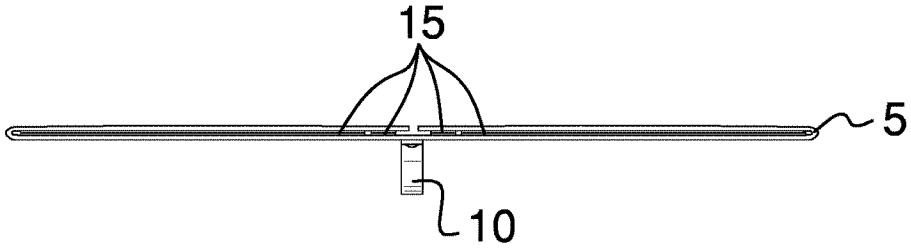
FIG. 3 is a bottom view of the first embodiment with the device empty.
Figure 4:
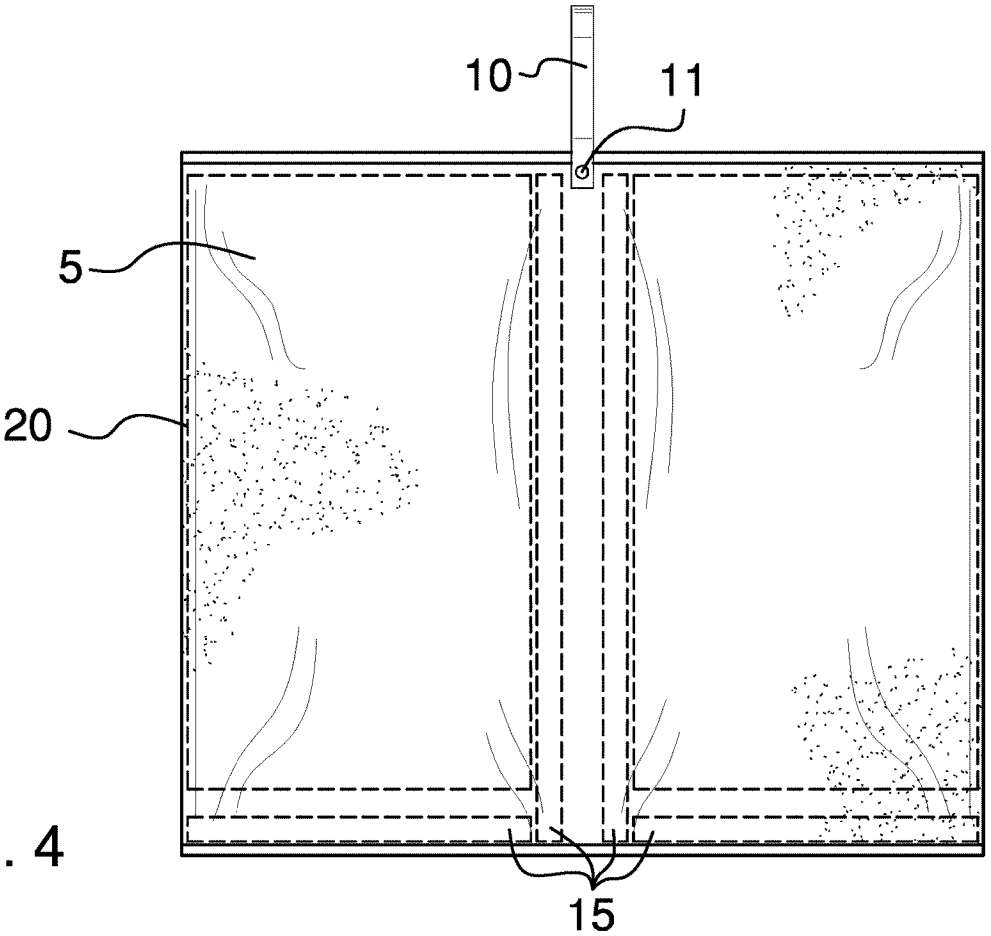
FIG. 4 is a back view of the first embodiment of the device with the device empty.
Figure 5:
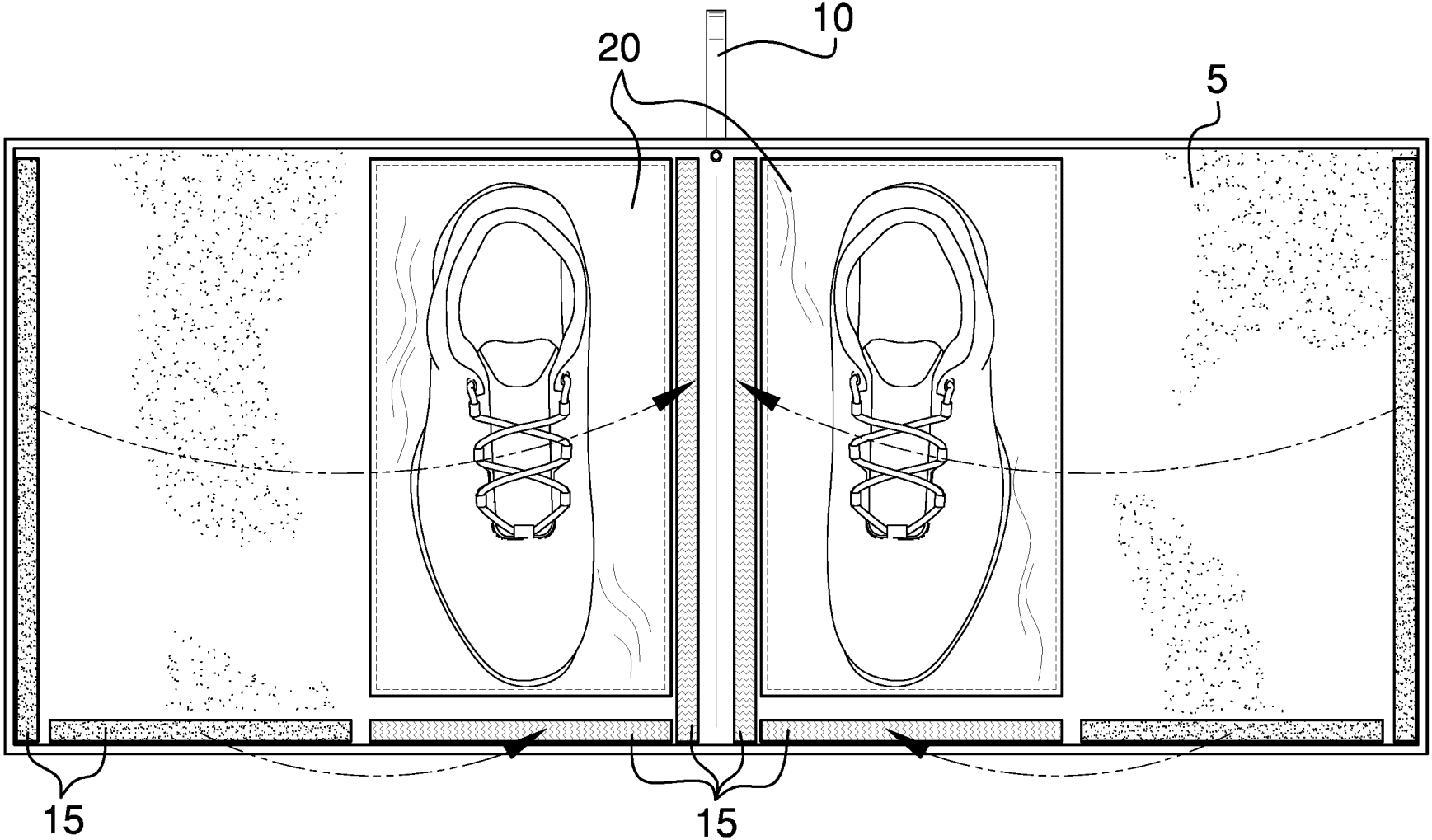
FIG. 5 is a view of the first embodiment of the opening with the golf towel combination carrier with the depictions of golf shoes within the interior spaces.

A connection means 15 that lines the perimeter of the surface on the opposite surface from the towel 5 will be provided to secure the two sections such as depicted in FIG. 5. The connection means 15 should be durable enough to withstand normal wear and tear and still remain connected. Possible examples to attach the sections include a hook and loop assembly, hooks and snaps and zipper material to name a few examples.

When the towel material 5 is folded over the respective shoe 25, the two sides will have golf towel material on the outside with the shoes placed within the respective pouch and a strap 10 will allow the device to be carried and hung off a golf bag as an example. A snap 11 is provided so that the strap 10 can be removed if the device is to be machine washed.

When the device is open such as depicted in FIG. 5, it will have two pouches 20 with liners on opposite sides of the centerline that will expose the pouches 20 into which the shoes may be placed.

Figure 6:
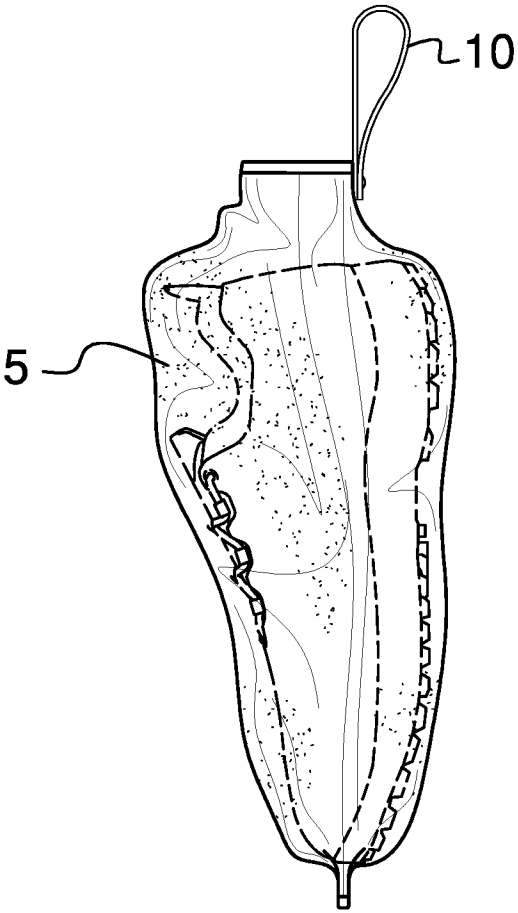
FIG. 6 is a side view of the first embodiment with the device closed depicting the golf shoe in the interior.

The device can be handwashed or machine-washed without destroying the material and the nylon liner may also be washed—either machine washed or hand washed—without destroying the golf towel material or the pouches. When shoes are placed within the nylon material, it will be as depicted by FIG. 6.

Second Embodiment

Figure 7:
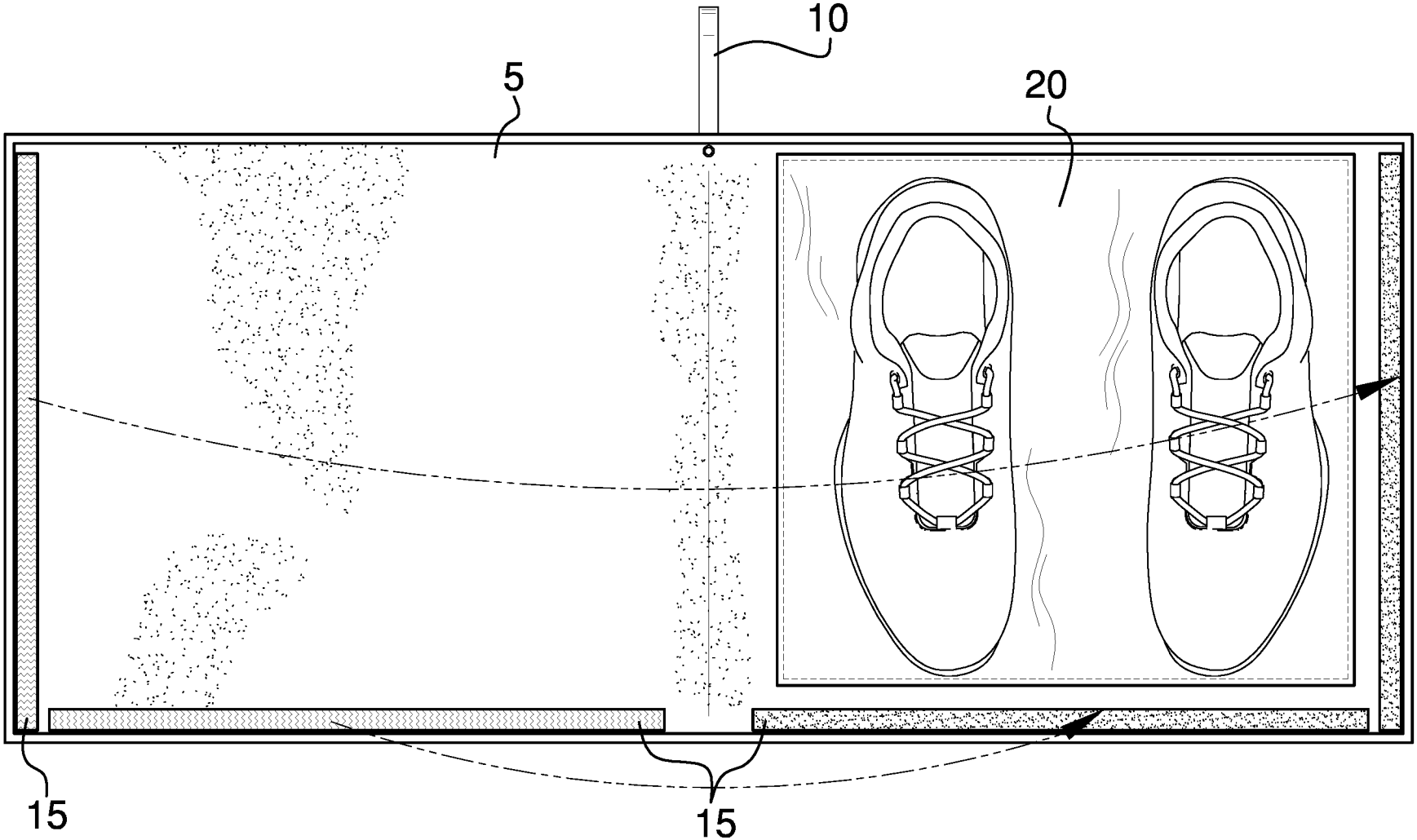
FIG. 7 is a front view of the second embodiment depicting the shoes in a single pouch.

In the second embodiment the shoes are placed on one side of the interior surface in the pouches 20 that are provided as depicted in FIG. 7. The connection material 15 will be provided on the interior of the device so that when the towel is folded over, the shoes will be self-contained in the respective pouch 20, which also contain a liner. In the second embodiment there may be a single pouch for both shoes or two pouches may be provided (not depicted).

While the invention has been described in the application, certain modifications may be made by those skilled in the art without departing from the essential features of this invention.

The inventor claims:

1. A combination shoe carrier and towel, which is comprised of:

a piece of material
wherein the piece of material is a predetermined shape,
wherein towel material is on the first side of the piece of material,
wherein a pair of pouches is provided on the second side of the piece of material,
wherein the piece of material has a top end and a bottom end,
a pair of pouches;
wherein the pair of pouches is provided on the second side of the piece of material;
wherein each of the pair of pouches will house one shoe,
wherein a pouch is provided for each shoe,
wherein each of the pair of pouches are positioned adjacent to each other,
wherein each pouch is placed on the sides adjacent to the centerline of the piece of material,
liner material;
wherein liner material is provided for each of the pair of pouches;
connection material;
wherein connection material is provided,
said connection material is provided on the second side of the device,
wherein connection material is provided on the interior surface adjacent to the pouches;
wherein connection material is provided on the outside perimeter on the second side,
wherein connection material is provided on the bottom end of the second side,
a strap;
wherein the strap is positioned in the middle of the top end of the second side,
wherein the strap can be removed.

2. The combination shoe carrier and towel as described in claim 1 wherein the device is hand washable.

3. The combination shoe carrier and towel as described in claim 1 wherein the device is machine washable.

4. The combination shoe carrier and towel as described in claim 1 wherein the connection material is hook and loop assembly.

5. The combination shoe carrier and towel as described in claim 1 wherein the connection material are button and snaps.

6. The combination shoe carrier and towel as described in claim 1 wherein the connection material is zipper material.

7. A combination shoe carrier and towel which is comprised of:

a piece of material
wherein the piece of material is a predetermined shape,
wherein towel material is on the first side of the piece of material,
wherein the piece of material has a top end and a bottom end,
a pair of pouches;
wherein the pair of pouches is provided on the second side of the piece of material;
wherein each pouch will house one shoe,
wherein the pair of pouches are placed on one side of the centerline of the device,
liner material,
wherein liner material is provided for each of the pouches;
connection material;
said connection material is provided on the second side of the device,
wherein connection material is provided on the perimeter of the second side;
wherein connection material is provided on the interior surface adjacent to the pouches;
wherein connection material is provided on the outside perimeter on the second side,
wherein connection material is provided on the bottom end of the second side,
a strap;
wherein the strap is positioned at the centerline of the top end of the second side,
wherein the strap can be removed.

8. The combination shoe carrier and towel as described in claim 7 wherein the device is hand washable.

9. The combination shoe carrier and towel as described in claim 7 wherein the device is machine washable.

10. He combination shoe carrier and towel as described in claim 7 wherein the connection material is hook and loop assembly.

11. The combination shoe carrier and towel as described in claim 7 wherein the connection material are button and snaps.

12. The combination shoe carrier and towel as described in claim 7 wherein the connection material is zipper material.

13. The combination shoe carrier and towel as described in claim 1 wherein the connection material on the second side can be placed over a single pouch.

14. The combination shoe carrier and towel as described in claim 1 wherein the connection material on the second side can be placed over two pouches.

15. The combination shoe carrier and towel as described in claim 7 wherein both pouches are placed to the right of the centerline of the piece of material.

16. The combination shoe carrier and towel as described in claim 7 wherein both pouches are placed to the left of the centerline of the piece of material.

* * * * *